US006280284B1

(12) United States Patent
Winefordner et al.

(10) Patent No.: US 6,280,284 B1
(45) Date of Patent: Aug. 28, 2001

(54) TOY SUBMARINE WITH COUNTER ROTATING PROPELLERS

(76) Inventors: Carl Winefordner; Frank Hermansen, both of 1812 Carmelita St., Laguna Beach, CA (US) 92651-3334

( * ) Notice: Subject to any disclaimer, the term of this patent is extended or adjusted under 35 U.S.C. 154(b) by 0 days.

(21) Appl. No.: 09/527,149

(22) Filed: Mar. 17, 2000

(51) Int. Cl.[7] ..... A63H 27/00
(52) U.S. Cl. ..... 446/162; 446/44
(58) Field of Search ..... 446/34, 36, 39, 446/41, 43, 44, 64, 160, 161, 57, 58, 59, 162, 163, 164

(56) References Cited

U.S. PATENT DOCUMENTS

| | | | | |
|---|---|---|---|---|
| 85,874 | * | 1/1869 | Tilden | 446/39 |
| 935,384 | * | 9/1909 | Martin | 446/58 |
| 2,138,168 | * | 11/1938 | Horak | 446/44 |
| 2,418,269 | * | 4/1947 | Lewis | 446/44 |
| 4,084,345 | * | 4/1978 | Tanaka | 446/44 |

* cited by examiner

*Primary Examiner*—Sam Rimell
(74) *Attorney, Agent, or Firm*—Leonard Tachner

(57) ABSTRACT

A toy submarine consisting of three components. Two of the components are an injection molded thermoplastic and the other is an ordinary rubber band. The plastic is slightly positively buoyant in typical tap water. The first molded component is the tailpiece and it includes a generally cylindrical body with an integrated propeller. The second molded component is the headpiece and it includes a generally cylindrical body with an integrated propeller that spirals in the opposite direction of the tailpiece propeller. Together they form a counter rotating propeller system. The bodies of both the tailpiece and the headpiece are hollow and open at both ends. One end of the tailpiece's body mates with one end of the headpiece's body such that their axes are aligned and the bodies are able to easily rotate relative to each other. The other ends of the tailpiece and headpiece each have a longitudinal slot. In the assembly, the rubber band is routed through the slot and around the body of the tail piece, then routed through both bodies of the tail and head pieces, and then through the slot and around the body of the head piece. To use the toy submarine, the child holds either the tail piece or the head piece and, using a finger, rotates the other propeller until the rubber band is sufficiently twisted. Then the toy submarine is placed under water and released. The two propellers will begin rotate in opposite directions. It will quickly travel in a relatively straight line in a forward direction until the energy in the rubber band has dissipated. Then, because the plastic that was used for molding the two components is slightly positively buoyant, the toy submarine will slowly surface.

6 Claims, 4 Drawing Sheets

TOY SUBMARINE WITH COUNTER ROTATING PROPELLERS

BACKGROUND OF THE INVENTION

Toy submarines are typically used by children in bathtubs and swimming pools. Toy submarines have been available in two varieties. One type is self-propelled and the other is not self-propelled. The self-propelled types are powered either by floatation, chemical reaction, battery, or a windup mechanism.

Floatation powered designs are generally made in such a configuration that they are lighter than the water they displace. When the submarine is released at below the water surface, as the submarine moves towards the water surface it will be propelled forwards depending on the shape and weight distribution of the toy. One of the problems with these designs is that in order for the submarine to move forward, it must be released at depth. That means that the potential forward movement in a bathtub is small and in a pool, a small child can only submerge the submarine to a shallow depth. Also, this design is incapable of self-propelled descending motion or self-propelled constant depth motion. Children can become easily bored with these designs.

Chemical reaction powered designs are generally configured to be slightly negatively buoyant. When a tablet of a chemical such as common baking soda is placed inside of a compartment in the submarine, as water reacts with the baking soda, gas is produced which is captured such that the buoyancy of the submarine becomes positive. When the buoyancy becomes positive, the submarine will climb to the surface. These designs share the same problems as floatation powered submarines and additionally have the cost and hassle and complexity of requiring an expendable chemical. Also, the motion is relatively slow.

Battery powered designs are usually neutrally buoyant and generally have a small battery powered motor with a single propeller. With a single propeller turning, there is a tendency for the submarine to rotate in the opposite direction of the propeller. In order to combat this tendency, the propeller is relatively small and the submarine is weighted such that the submarine will tend to remain in a generally upright orientation. In actual use, these submarines twist at an odd angle in response to the motor-driven propeller. Battery powered submarines move very slowly because of the relatively small propeller and in order to prevent the submarine from twisting at too great of an angle. If too much power were introduced to the propeller, then the submarine would begin to rotate repeatedly in the direction opposite to the propeller. While in theory it would be possible to use a counter-rotating propeller system to solve some of the above problems, in reality this would add too much complexity and cost for a simple toy. Some battery-powered designs also include a chemical reaction system for surfacing.

Existing wind-up powered designs are similar to battery powered designs except that they use a wind-up mechanism instead of a battery and motor. The wind-up mechanism usually includes a metal spring, small gears and a knob for the child to twist in order to create the potential energy. The problem with these designs is that the distance traveled is small because the wind up mechanism allows relatively few windings, the motion is slow, and the buoyancy is such that the "submarine" is really more like a "boat". Also, the motion is not in a straight line.

It is desirable for the toy submarine to be simple to use and operate even for very young children. It is also desirable for the toy submarine to be inexpensive and easy to manufacture. It is also desirable for the toy submarine to not contain any small, sharp components so that it is safe for very young children. It is also desirable for the toy submarine to move through the water in a relatively straight line. It is also desirable for the toy submarine to require little or no maintenance. It is also desirable for the toy submarine to be able to move across swimming pools after being wound up.

SUMMARY OF THE INVENTION

Our toy submarine, in its most basic form, consists of three components. Two of the components are preferably injection molded thermoplastic and the other is an ordinary rubber band. The plastic is slightly positively buoyant in typical tap water. The first molded component is the tailpiece and it includes a generally cylindrical body with an integrated propeller. The second molded component is the headpiece and it includes a generally cylindrical body with an integrated propeller that spirals in the opposite direction of the tailpiece propeller. Together they form a counter-rotating propeller system.

The bodies of both the tailpiece and the headpiece are hollow and open at both ends. One end of the tailpiece's body mates with one end of the headpiece's body such that their axes are aligned and the bodies are able to easily rotate relative to each other. The other ends of the tailpiece and headpiece each have a longitudinal slot. In the assembly, the rubber band is routed through the slot and around the body of the tail piece, then routed through both bodies of the tail and head pieces, and then through the slot and around the body of the head piece.

To use the toy submarine, the child holds either the tail piece or the head piece and, using a finger, rotates the other propeller until the rubber band is sufficiently twisted. Then the toy submarine is placed under water and released The two propellers will begin rotate in opposite directions. It will quickly travel in a relatively straight line in a forward direction until the energy in the rubber band has dissipated. Then, because the plastic that was used for molding the two components is slightly positively buoyant, the toy submarine will slowly surface. If used in a bathtub, the toy submarine will travel straight ahead until it bumps into a wall of the bathtub or some other object and may turn around on its own depending on the contours of the objects encountered.

OBJECTS OF THE INVENTION

An object of the present invention is to provide a toy submarine that is primarily made from two injection-molded components and one rubber band. Another object of the present invention is for the toy submarine to be simple to use and operate even for very young children. Another object of the present invention is for the toy submarine to be inexpensive and easy to manufacture. Another object of the present invention is for the toy submarine to not contain any small, sharp components so that it is safe for very young children. Another object of the present invention is for the toy submarine to move through the water in a relatively straight line. Another object of the present invention is for the toy submarine to require little or no maintenance. Another object of the present invention is for the toy submarine to be able to move relatively far through water after being wound up.

The foregoing and other objects are attained, according to the present invention, by the assembly described below.

BRIEF DESCRIPTION OF THE DRAWINGS

The aforementioned objects and advantages of the present invention, as well as additional objects and advantages thereof will be more fully understood hereinafter, as a result of a detailed description of preferred embodiments thereof, when taken in conjunction with the following drawings in which.

REFERENCE NUMERALS IN DRAWINGS

Figure 1:
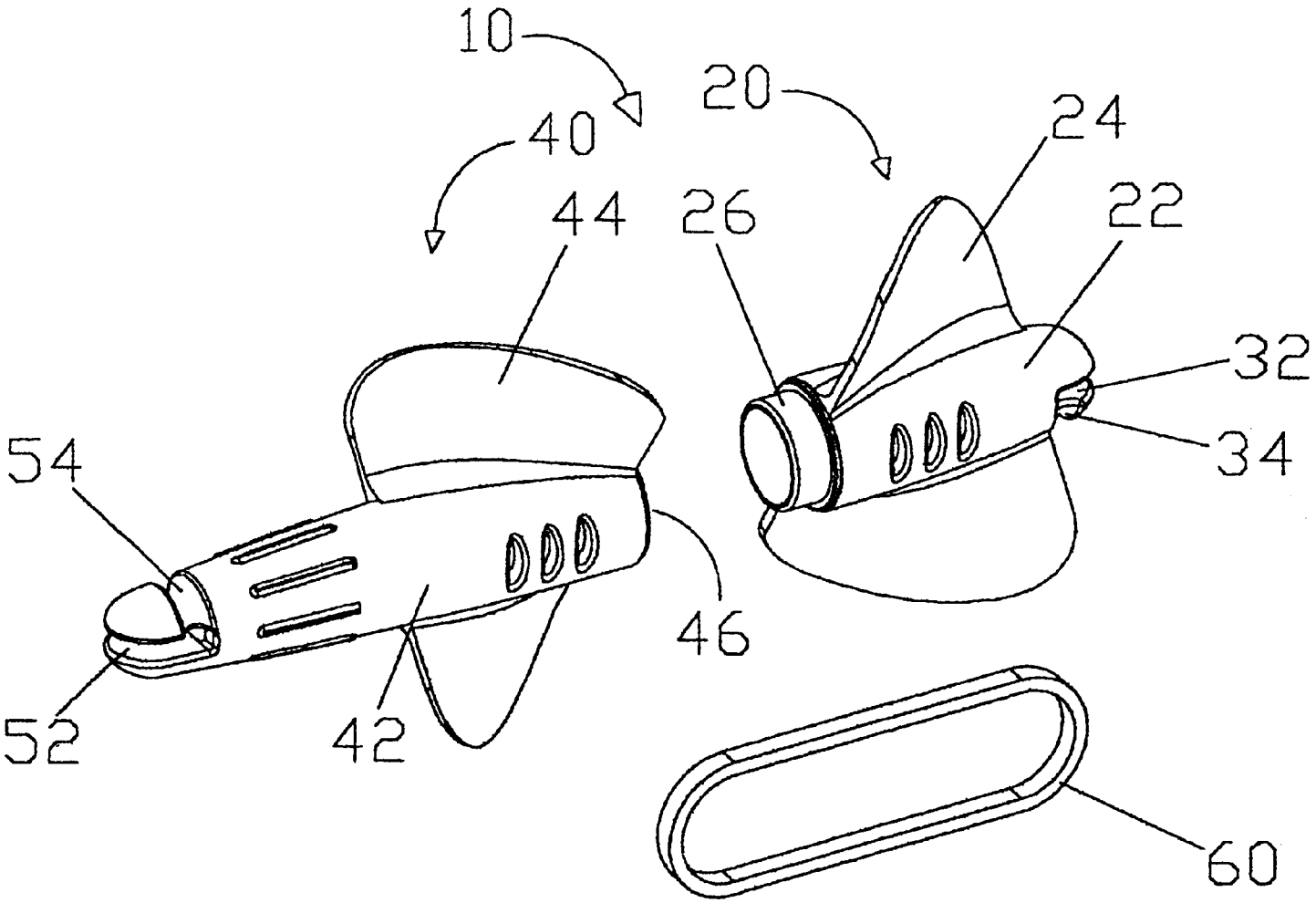
FIG. 1 is a pictorial exploded view of the toy submarine from side and towards the front.

| | |
|---|---|
| 10 | toy submarine |
| 20 | tailpiece |
| 22 | body |
| 24 | propeller |
| 26 | flange |
| 28 | opening |
| 32 | slot |
| 34 | curved recess |
| 40 | head piece |
| 42 | body |
| 44 | propeller |
| 46 | recess |
| 48 | opening |
| 52 | slot |
| 54 | curved recess |
| 56 | friction ridges |
| 60 | rubber band |

DETAILED DESCRIPTION OF PREFERRED EMBODIMENT

The preferred embodiment of the present invention may be understood by referring to FIGS. 1–5. It will be seen that a toy submarine 10 comprises an injection-molded tailpiece 20, an injection molded headpiece 40, and an ordinary rubber band 60. The tailpiece 20 has a hollow body 22, a counter-clockwise spiraling propeller 24, a flange 26, openings 28, a slot 32, and a curved recess 34. The headpiece 40 has a hollow body 42, a clockwise spiraling propeller 44, a recess 46, openings 48, a slot 52, a curved recess 54, and friction ridges 56. The material used to mold the tailpiece and headpiece is a thermoplastic such as a certain blend of polyethylene that is slightly positively buoyant in water. For assembly, the rubber band 60 is wrapped around the curved recess 34 of the tailpiece 20, then routed through the slot 32, and out of the other end of the body 22. Then the rubber band 60 is routed through the body 42 of the headpiece 40, through the slot 52, and around the curved recess 54. The flange 26 is held inside the recess 46 by the pull of the rubber band 60. The purpose of openings 28 of the tail piece 20 and the openings 48 of the head piece 40 is to allow air to escape from within the bodies 22 and 42 when the toy submarine 10 is placed under water so that it has the desirable buoyancy in water.

In FIG. 1, there is an exploded view of the toy submarine 10. The toy submarine 10 comprises an injection-molded tailpiece 20, an injection molded headpiece 40, and an ordinary rubber band 60. The tailpiece 20 has a hollow body 22, a counter-clockwise spiraling propeller 24, a flange 26, a slot 32, and a curved recess 34. The headpiece 40 has a hollow body 42, a clockwise spiraling propeller 44, a recess 46, a slot 52, and a curved recess 54. In the assembly, the rubber band 60 is wrapped around the curved recess 34 of the tailpiece 20, then routed through the slot 32, and out of the other end of the body 22. Then the rubber band 60 is routed through the body 42 of the headpiece 40, through the slot 52, and around the curved recess 54. When assembled, the flange 26 is held inside the recess 46 by the pull of the rubber band 60. The material used to mold the tailpiece 20 and headpiece 40 is a thermoplastic such as a certain blend of polyethylene that is slightly positively buoyant in water.

Figure 2:
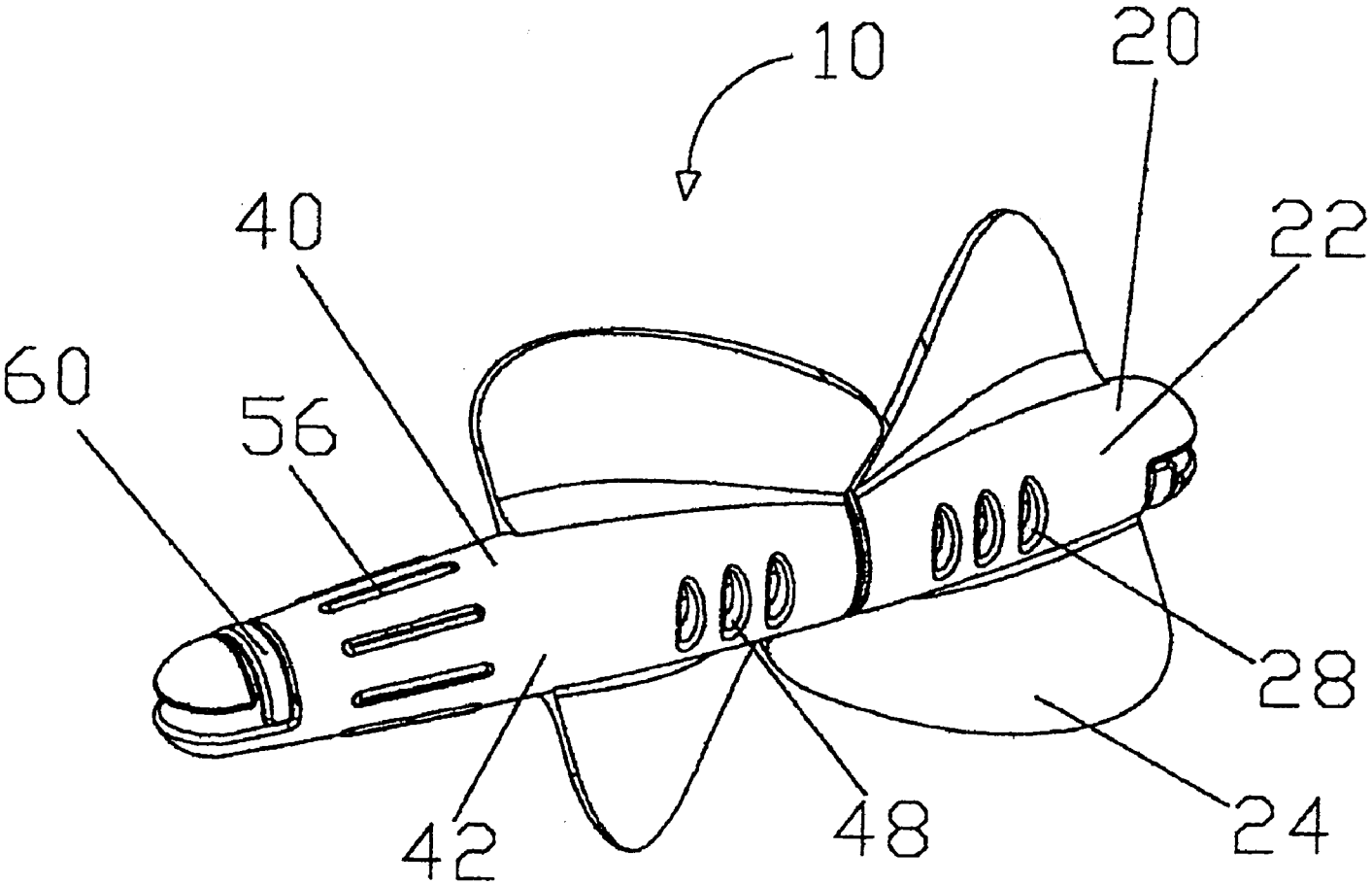
FIG. 2 is a pictorial view of the assembled toy submarine from the side and towards the front.

In FIG. 2, there is a pictorial view of the assembled toy submarine 10. The toy submarine 10 comprises an injection-molded tailpiece 20, an injection molded headpiece 40, and an ordinary rubber band 60. The purpose of openings 28 of the tail piece 20 and the openings 48 of the head piece 40 is to allow air to escape from within the bodies 22 and 42 when the toy submarine 10 is placed under water so that it has the desirable buoyancy in water. There are at least two ways to easily wind up the toy. The child can hold the tailpiece 20 in one hand and twists the headpiece 40 in a clockwise direction with their other hand using friction ridges 56 for traction. Alternatively, the child can hold the headpiece 40 in one hand and wind the tailpiece 20 by using their finger against the propeller 24.

Figures 3A, 3B, 3C:
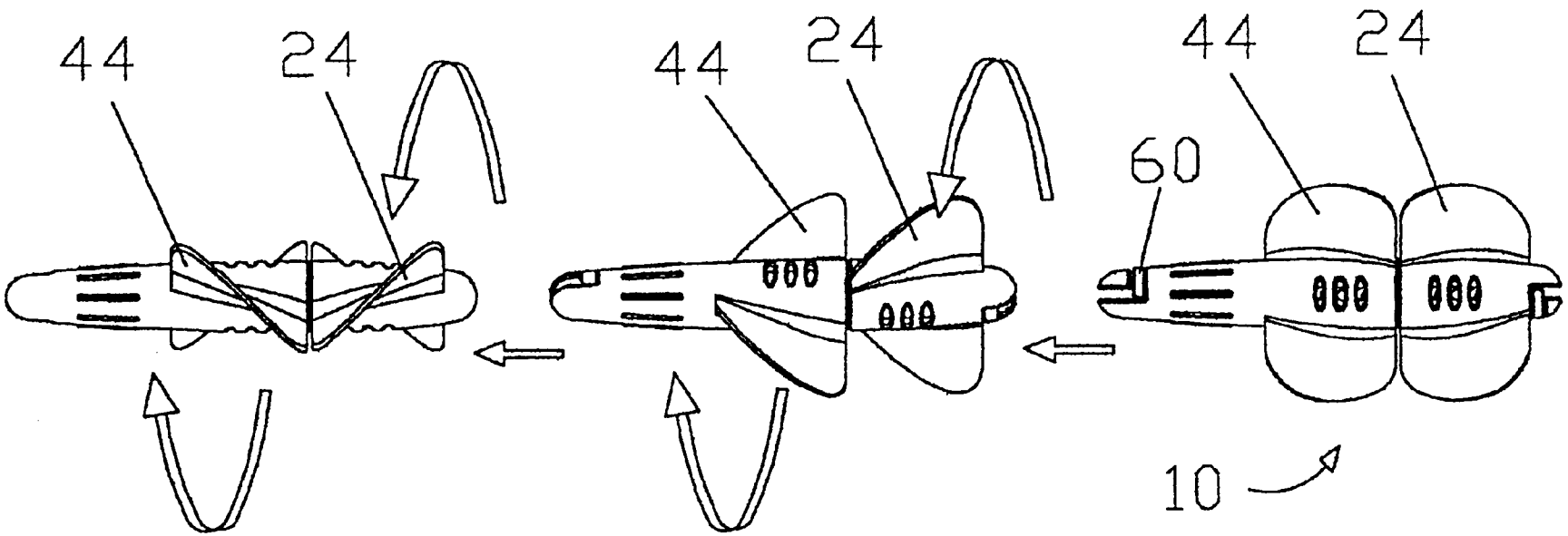
FIG. 3 is a pictorial view from the side showing three stages of motion as the toy submarine moves through water.

In FIG. 3, there is a pictorial view showing three stages of motion as the toy submarine 10 moves through water. In view A, the toy submarine 10 has just been released in the water after having been wound up. Propellers 24 and 44 begin to counter rotate. In view B, propellers 24 and 44 have counter-rotated 90 degrees relative to one another. The toy submarine 10 has begun to move forward through the water as both propellers simultaneously produce thrust. In view C, propellers 24 and 44 have counter rotated another 90 degrees relative to one another. The toy submarine 10 continues to move forward through the water. Forward motion will continue until the rubber band 60 has sufficiently unwound. The forward motion is relatively straight because the counter-rotating propellers produce a net force in a straight line. The pitch of the propellers 24 and 44 shown is 8 inches. The toy submarine 10 will be propelled only slightly less than 4 inches forward for each winding of the rubber band 60 because the propellers 24 and 44 are relatively large compared to the overall size of the toy submarine 10. For this reason, the toy submarine 10 can, for example, propel itself across a 20-foot wide pool with only about 65 windings of the rubber band. Up to a point where efficiency suddenly drops, the longer the propeller pitch, the farther and slower the toy submarine will move.

Figure 4:
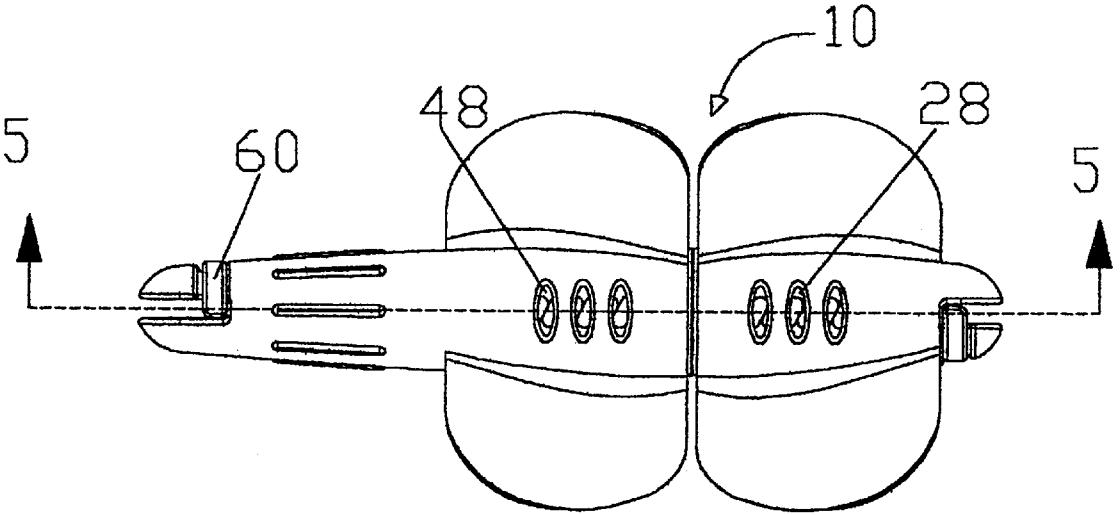
FIG. 4 is a pictorial view of the toy submarine from the side.

In FIG. 4, there is a pictorial view of the toy submarine 10. The rubber band 60 can be seen as wound up through the openings 28 and 48.

Figure 5:
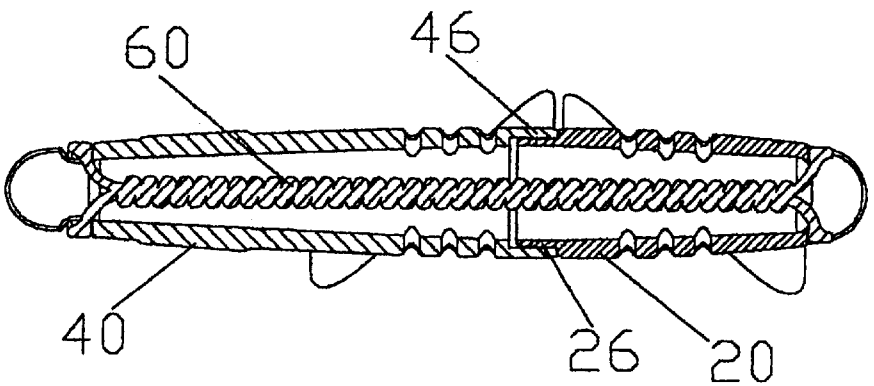
FIG. 5 is a sectional view of the toy submarine shown in FIG. 4.

In FIG. 5, there is a sectional view of the toy submarine shown in FIG. 4. The flange 26 of tailpiece 20 nests inside of recess 46 of headpiece 40. The fit between the flange 26 and the recess 46 provides alignment while allowing rotation. The rubber band 60, which holds the assembly together, is wound up.

Other Embodiments

Now that the preferred embodiment is described, those skilled in the art could easily imagine other embodiments. For example, the toy submarine could easily be powered by a custom molded thermoplastic elastomer member or compression molded rubber member instead of an ordinary rubber band. Many different configurations of stretchable members could easily be used to power the toy submarine.

Also, the ends of the stretchable member could be shaped differently to attach to the ends of the tailpiece and headpiece differently. Also, two or more rubber bands could be grouped together and used in place of a single rubber band. Also, the rubber band could attach to the ends of the tailpiece and the headpiece in a variety of different ways.

The proportions of the propeller blades to the bodies could be very different. For example, the body portion could be much longer in order to provide length for more windings of the rubber band so that the toy submarine travels farther. Another example is that the propeller could proportionally extend farther from the axis of rotation. This version would travel more slowly. The size of the toy submarine could be relatively small (less than an inch long total) or big (longer than a foot) or anywhere in between. For very small children, the toy submarine can be made with components that are large enough and rounded enough to be as safe as possible.

While the preferred embodiment is made of only two molded components and one rubber band, the tailpiece and headpiece could each be made of two or more components. The reasons for making the toy submarine this way could be, for example, to provide different aesthetics or to enable making portions of the toy submarine out of a very soft and flexible material while still having a slippery and hard material for supporting the rubber band and for allowing low friction rotation between the head piece and the tail piece. Another advantage of making the tailpiece and headpiece out of two or more components each would be to make changing rubber bands easier or for manufacturing reasons.

Additional Request for Constructive Assistance

If for any reason this application is not believed to be in full condition for allowance, applicant respectfully requests the constructive assistance and suggestions of the Examiner, pursuant to M.P.E.P. 706.03 (d) and 707.07(j) in order that the undersigned can place this application in allowable condition as soon as possible without the need for further proceedings.

What is claimed is:

1. A toy submarine comprising a hollow, oblong, tubular-shaped, multi-part body simulating a submarine that has buoyancy in water and at least one passage permitting air to exit the hollow interior when the submarine is under water; said body having axially adjacent parts forming said hollow interior along a common axis; at least a first said body part having a first propeller extending radially therefrom and at least a second said body part having a second propeller extending radially therefrom;

a stretchable member attached to said first and second body parts to assist oppositely directed rotation of said first and second propellers and thereby store energy to cause oppositely directed rotation of said propellers and propel said submarine through water.

2. The toy submarine recited in claim 1 wherein said first and said second propellers have at least two propeller blades each.

3. The toy submarine recited in claim 2 wherein said stretchable member is a rubber band.

4. The toy submarine recited in claim 2 wherein said propeller blades of said first and second propeller members have a pitch of at least one inch.

5. The toy submarine recited in claim 1 wherein said first and said second propellers are made from an injection molded thermoplastic.

6. The toy submarine recited in claim 1 wherein said stretchable member extends along said hollow interior of said adjacent body parts.

* * * * *